US011691174B2

(12) United States Patent
Poppe et al.

(10) Patent No.: US 11,691,174 B2
(45) Date of Patent: Jul. 4, 2023

(54) CAULKING GUN

(71) Applicant: Altachem NV, Harelbeke (BE)

(72) Inventors: Jean-Marie Poppe, Harelbeke (BE); Niels Vanlerberghe, Harelbeke (BE); Jonathan Callens, Harelbeke (BE)

(73) Assignee: Altachem NV, Harelbeke (BE)

( * ) Notice: Subject to any disclaimer, the term of this patent is extended or adjusted under 35 U.S.C. 154(b) by 179 days.

(21) Appl. No.: 17/434,860

(22) PCT Filed: Mar. 16, 2020

(86) PCT No.: PCT/EP2020/057146
§ 371 (c)(1),
(2) Date: Aug. 30, 2021

(87) PCT Pub. No.: WO2020/187852
PCT Pub. Date: Sep. 24, 2020

(65) Prior Publication Data

US 2022/0184655 A1 Jun. 16, 2022

(30) Foreign Application Priority Data

Mar. 20, 2019 (BE) ..... 2019/5171

(51) Int. Cl.
*B05C 17/005* (2006.01)
*B05C 17/01* (2006.01)

(52) U.S. Cl.
CPC .... *B05C 17/00596* (2013.01); *B05C 17/0123* (2013.01)

(58) Field of Classification Search
CPC ..... B05C 17/00596; B05C 17/0123
See application file for complete search history.

(56) References Cited

U.S. PATENT DOCUMENTS 4,840,294 A 6/1989 Ernst
5,381,931 A 1/1995 Chang
(Continued)

FOREIGN PATENT DOCUMENTS

EP 0 486 455 A2 5/1992
EP 2135683 A2 * 12/2009 ..... B05C 17/0103
(Continued)

OTHER PUBLICATIONS

International Search Report in PCT/EP2020/057146, dated Jul. 18, 2020.
(Continued)

*Primary Examiner* — Bob Zadeh
(74) *Attorney, Agent, or Firm* — Collard & Roe, P.C.

(57) ABSTRACT

A caulking gun for dispensing material includes a stock, a cartridge keep, a push rod longitudinally moveably mounted in the stock with one end having a plunger engaging a cartridge piston in the cartridge keep, a catch on the rod, a trigger coupled to the catch via an axle and pivoting about a pivot point, and a device for varying thrust output exerted on the rod when pressing the trigger for a given strength exerted on the trigger that allows axle displacement between at least first and second positions. The trigger has an upper part with a trigger bridge with two long holes. The thrust output varying device includes a ratio bridge element put over the trigger bridge and trigger and linked to the trigger bridge via the axle traversing the holes. By displacing the axle either between fixed values or continuously and the thrust output can be varied between fixed values or continuously.

6 Claims, 2 Drawing Sheets

(56) References Cited

U.S. PATENT DOCUMENTS

Figure 1:
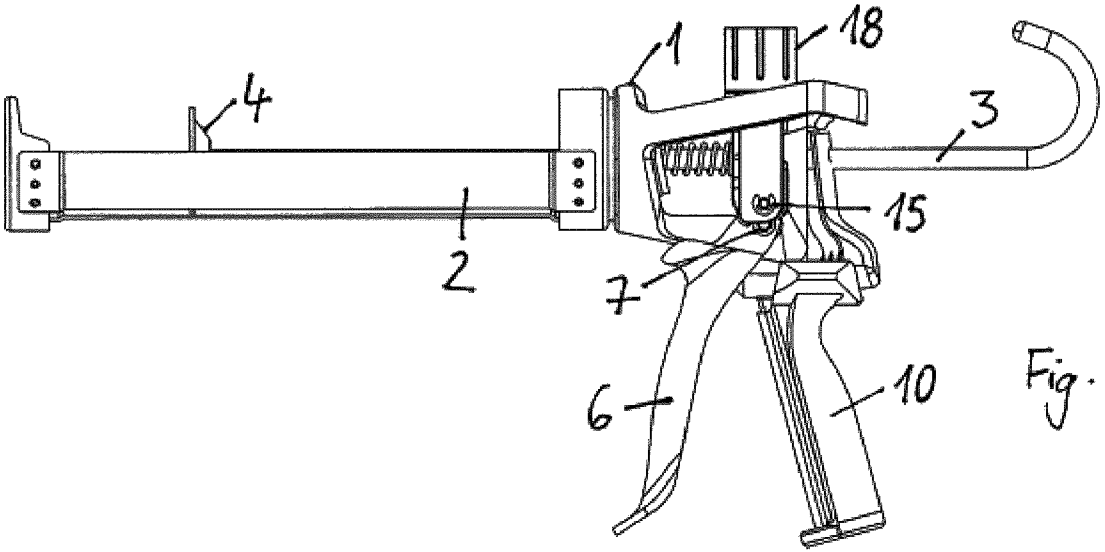

| | | | | |
|---|---|---|---|---|
| 5,755,362 | A * | 5/1998 | Rodriguez, Jr. | B05C 17/0123 222/391 |
| 6,050,453 | A * | 4/2000 | Kelders | B05B 12/002 222/323 |
| 2012/0273528 | A1* | 11/2012 | Strobel-Schmidt | B05C 17/0123 222/391 |
| 2013/0161360 | A1 | 6/2013 | Marsden et al. | |
| 2019/0299244 | A1* | 10/2019 | Xia | B05C 17/0123 |
| 2022/0184655 | A1* | 6/2022 | Poppe | B05C 17/0123 |

FOREIGN PATENT DOCUMENTS

| | | | | |
|---|---|---|---|---|
| EP | 2954959 | A1 * | 12/2015 | B05C 17/00596 |
| GB | 1 011 470 | A | 12/1965 | |
| GB | 1011470 | A * | 12/1965 | |
| GB | 2445421 | A * | 7/2008 | A61B 17/8822 |
| WO | WO-9713587 | A1 * | 4/1997 | B05B 12/002 |
| WO | 2018/055024 | A1 | 3/2018 | |

OTHER PUBLICATIONS

English translation of International Preliminary Report on Patentability in PCT/EP2020/057146, dated Jun. 28, 2021.
Attorneys Response to International Preliminary Report on Patentability in PCT/EP2020/057146, dated Nov. 4, 2020.

* cited by examiner

CAULKING GUN

CROSS REFERENCE TO RELATED APPLICATIONS

This application is the National Stage of PCT/EP2020/057146 filed on Mar. 16, 2020, which claims priority under 35 U.S.C. § 119 of Belgium Application No. 2019/5171 filed on Mar. 20, 2019, the disclosure of which is incorporated by reference. The international application under PCT article 21(2) was published in English.

The invention concerns a caulking gun for dispensing material comprising

- a stock,
- a cartridge keep,
- a push rod longitudinally moveably mounted in the stock provided at its one end with a plunger which engages the piston of a cartridge placed in the cartridge keep,
- a catch member placed on the push rod,
- a trigger coupled to the catch member via an axle and pivoting about a pivot point,
- means for varying the thrust output exerted on the push rod when pressing the trigger for a given strength exerted on the trigger, wherein the means for modifying the strength allow the displacement of the axle onto which the load of the trigger is applied between at least a first position and a second position.

A caulking gun for dispensing viscous material which does not have any freeloop is described in WO 2018/055024 A1.

U.S. Pat. No. 4,840,294 A describes a tool for use in dispensing fluids which has an actuating mechanism which includes a lever which is adjustable to accommodate materials of varying viscosities. Adjustment is achieved by axially moving a bolt within the trigger of the tool, thereby varying the mechanical advantage of the trigger.

U.S. Pat. No. 5,381,931 A describes a caulking gun incorporating an adjustment feature which allows the user of the caulking gun to vary the thrust output while using the gun. The adjustment is accomplished by means of a selection dial pivotally mounted for orthogonal rotation about an upward tip of the trigger. This prior art solution allows to vary the thrust output between fixed values.

US 2013/0161360 A1, EP 486 455 A2 and GB 1,011,470 A describe caulking guns with an adjustable thrust mechanism for changing the force applied by the trigger when dispensing the caulk material.

The objective of the present invention is to provide a caulking gun which allows in a very simple way to vary the thrust output either between fixed values or continuously. This objective is achieved in that the trigger is provided on its upper part with a trigger bridge in which two long holes are provided and the means for varying the thrust output comprise a ratio bridge element which is put over the trigger bridge and trigger and which is linked to the trigger bridge via the axle which traverses the two long holes and that engages the catch member.

The means for varying the thrust output comprise a variable lever system. Effort, effort arm and fulcrum as part of the trigger, are invariable. Load and load arm are variable by means of a ratio bridge element holding the load axle. The ratio bridge element slides over the load arm of the trigger. This load arm of the trigger houses a slot in which the load axle can move to its extremes by means of adjusting the ratio bridge element. This slot (long hole) allows to vary the thrust ratio. By displacing the load either between fixed values or continuously, the thrust output can be varied between fixed values or continuously.

The adjustment of the ratio bridge element changes the length of the load arm and as such the mechanical advantage of the lever system or the thrust ratio of the presented caulking gun.

According to a preferred embodiment of the invention, the ratio between the strength exerted on the trigger and the thrust output on the push rod is adjustable within a range from 1:7 to 1:25.

According to a preferred embodiment of the invention, the ratio between the strength exerted on the trigger and the thrust output exerted on the push rod is freely adjustable at any intermediate value between 1:7 and 1:25.

According to another preferred embodiment of the invention, the ratio between the strength exerted on the trigger and the thrust output exerted on the push rod is adjustable at fix values.

In this context, the fix values are preferably 1:7, 1:12, 1:18 and 1:25.

According to a further preferred embodiment, a turn button is provided on the ratio bridge element for adjusting the thrust output.

This turn button can be placed on top of the ratio bridge element so that it is easily accessible for the user.

Figure 2:
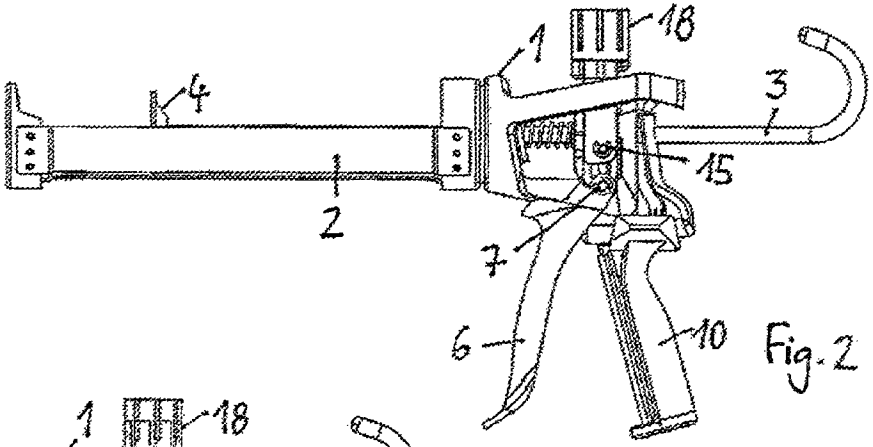
Figure 4:
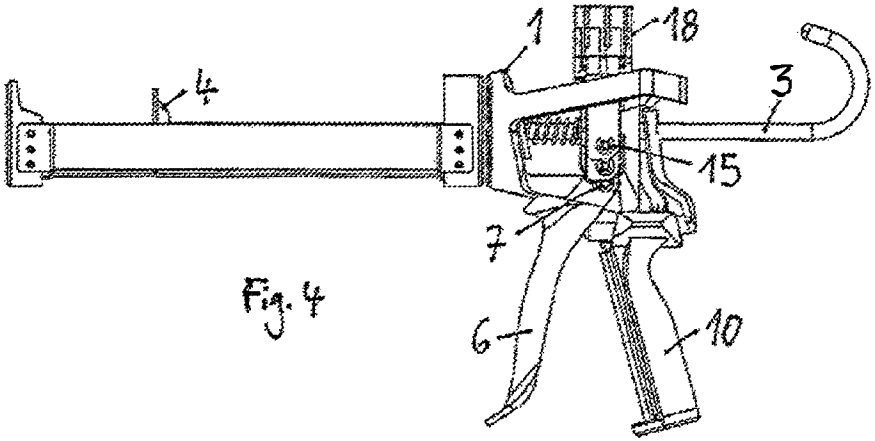
Figure 3:
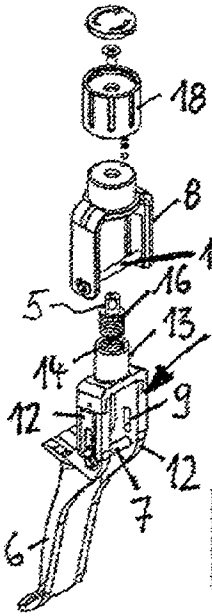

Hereafter, a preferred embodiment of the invention will be explained with reference to the figures in which FIG. 1 shows a side view of a caulking gun according to the invention in the low position, FIG. 2 shows a side view of a caulking gun according to the invention in the low position, FIG. 3 shows an exploded view of the components of the mechanism allowing to modify the thrust output, FIG. 4 shows a side view of the caulking gun at different thrust outputs.

As shown in FIGS. 1, 2 and 4, the caulking gun according to the invention has a stock 1 in front of which is provided a cartridge keep 2 for receiving a cartridge of caulk material.

A push rod 3 is longitudinally moveably mounted in the stock 1. This push rod 3 is provided at its front end with a plunger 4 which engages the piston of a cartridge placed in the cartridge keep 2. The rear end of the push rod 3 is curbed. It could also be otherwise terminated.

Furthermore, a handle 10 is fixed to the stock 1. In front of the handle 10, a trigger 6 is provided for activating the caulking gun. When the trigger 6 is activated, the push rod 3 moves forward thereby advancing the piston and putting out the product contained in the cartridge. This trigger is pivoting about a fulcrum or pivot point 7.

Means are provided for varying the thrust output exerted on the push rod 3 when pressing the trigger 6 for a given strength exerted on the trigger 6. These means for modifying the thrust output allow the displacement of the load 15 between at least a first position and a second position.

FIG. 3 shows how the means for varying the thrust output exerted on the push rod 3 are configured. The trigger 6 has in its upper part (load arm) a U-formed end fitting, called trigger bridge 11, on the two legs 12 in which slots (long holes) 9 are provided. On the upper side of the trigger bridge 11, an inner thread 14 is provided in a cylindrical extension 13 for receiving a screw element 16.

A ratio bridge element 8 which is also U-formed is put over this trigger bridge 11 and linked to the trigger 6 via an axle 15 which traverses the two long holes 9. The pivot point 7 of the trigger 6 is applied at the level of this axle 15. A cylindrical element 17 is provided on the top of the ratio bridge element 8. This cylindrical element 17 extends over the inner thread 14 when the ratio bridge element 8 is mounted on the trigger 6.

By turning the screw element 16 via a turn button 18 which is on top of the cylindrical element 17, the axle 15 of the trigger 6 can be lowered or elevated, thereby varying the thrust output exerted on the push rod 3 when pressing the trigger 6 for a given strength on the trigger 6.

When the means for varying the thrust output exerted on the push rod 3 are mounted, the axle 15 engages the catch member 5 which in its turn engages the push rod 3. This allows to transfer the movement of the trigger 6 to the push rod 3 on which the catch member 5 is arranged.

According to this preferred embodiment of the invention, the ratio between the strength exerted on the trigger and the thrust output exerted on the push rod is freely adjustable at any intermediate value between 1:7 and 1:25. FIG. 1 shows the caulking gun in the low position, FIG. 2 in the high position and FIG. 4 shows the variation between both of them which is achieved by turning the turn button 18.

By adding a discrete step spring and a discrete step ball between the screw element 16 and the ratio bridge element 8 or between the ratio bridge element 8 and the trigger bridge 11 or trigger 6, it is possible to add steps to an otherwise continuously variable thrust ratio.

The ratio between the strength exerted on the trigger and the thrust output exerted on the push rod is in this case adjustable at fix values, e.g. 1:7, 1:12, 1:18 and 1:25 or any ratio desirable by the customer.

The invention claimed is:

1. A caulking gun for dispensing material comprising a stock (1), a cartridge keep (2), a push rod (3) longitudinally moveably mounted in the stock (1) provided at one end of the rod with a plunger (4) which engages a piston of a cartridge placed in the cartridge keep (2), a catch member placed on the push rod (3), a trigger (6) coupled to the catch member via an axle (15) and pivoting about a pivot point (7), means for varying a thrust output exerted on the push rod (3) when pressing the trigger (6) for a given strength exerted on the trigger (6), wherein the means for modifying the thrust output allow the displacement of the axle (15) between at least a first position and a second position, wherein the trigger (6) has an upper part with a trigger bridge (11) in which two long holes (9) are provided and the means for varying the thrust output comprise a ratio bridge element (8) which is put over the trigger bridge (11) and trigger (6) and which is linked to the trigger (6) via the axle (15) which traverses the two long holes (9) and that engages the catch member.

2. The caulking gun according to claim 1, wherein the ratio between the strength exerted on the trigger (6) and the thrust output on the push rod (3) is adjustable within a range from 1:7 to 1:25.

3. The caulking gun according to claim 1, wherein the ratio between the strength exerted on the trigger (6) and the thrust output exerted on the push rod (3) is freely adjustable at any intermediate value between 1:7 and 1:25.

4. The caulking gun according to claim 1, wherein the ratio between the strength exerted on the trigger (6) and the thrust output exerted on the push rod (3) is adjustable at fix values.

5. The caulking gun according to claim 4, wherein the fix values are 1:7, 1:12, 1:18 and 1:25.

6. The caulking gun according to claim 1, wherein a turn button (18) is provided on the ratio bridge (8) element for adjusting the thrust output.

* * * * *